United States Patent [19]

Butler

[11] 4,072,402

[45] Feb. 7, 1978

[54] ELECTRICAL CONNECTOR

[76] Inventor: Robert J. Butler, 101 Bowdoin St., Malden, Mass. 02148

[21] Appl. No.: 650,434

[22] Filed: Jan. 19, 1976

[51] Int. Cl.[2] ..... H01R 13/46

[52] U.S. Cl. ..... 339/136 M; 339/186 M

[58] Field of Search ..... 339/65, 66 R, 66 M, 339/136 R, 136 M, 137, 139 R, 139 C, 140 R, 140 C, 142, 186 R, 186 M

[56] References Cited

U.S. PATENT DOCUMENTS

| | | | |
|---|---|---|---|
| 2,790,153 | 4/1957 | Arson | 339/142 X |
| 2,987,693 | 6/1961 | Wamsley | 339/65 X |
| 3,032,737 | 5/1962 | Rottmann | 339/137 X |
| 3,277,426 | 10/1966 | Klostermann | 339/136 M X |
| 3,873,172 | 3/1975 | Paullus | 339/186 M X |

*Primary Examiner*—Roy Lake
*Assistant Examiner*—Howard N. Goldberg

[57] ABSTRACT

A NAFI type connector having an extruded aluminum H-shaped metal sheath with opposing planar side walls engaging a plastic body with metal connector pins embedded therein, the side walls being maintained in fixed spaced relationship by a bridge having an opening through which the keying pin passes.

4 Claims, 11 Drawing Figures

ELECTRICAL CONNECTOR

A NAFI type connector having an extruded aluminum H-shaped metal sheath with opposing planar side walls engaging a plastic body with metal connector pins embedded therein, the side walls being maintained in fixed spaced relationship by a bridge having an opening through which the keying pin passes.

SUMMARY OF THE INVENTION

This invention relates to a NAFI type electrical connector having a metal sheath and pin-protection skirt assembly. More particularly, it relates to an integral connector sheath providing numerous advantages over the connectors previously in use.

In connectors of this type, metal pins are embedded in a small plastic bar, which forms the body of the connector, with one end of each pin extending from one surface of the body to make a removable connection with a female connector and the other end extending from another surface of the plastic body to make permanent connection with desired circuit components. The plastic body is provided with an opening near each end to receive a keying pin for aligning a mating connector.

In conventional NAFI connectors, two metal strips cemented to opposite sides of the plastic body form skirts extending beyond the body to provide mechanical protection for the connector pins. These metal strips are the source of numerous difficulties with these connectors. The strips, secured by cement, sometimes come loose from the plastic body after the connector has been installed. The electronic modules that are permanently attached to the connector are generally of such value that it is not practical to discard the unit, and the skirt along with any other damaged elements must be repaired. To minimize the chance either of the skirts will pull loose, the connectors are routinely subjected to a six-pound pull test on each corner of the metal strip. The testing of each unit in this manner and the resulting failure of a number of units adds materially to the cost of the connectors. Moreover, since the metal strips are secured solely by means of adhesive, a considerable amount of adhesive is required and the build up of adhesive between the strip and the plastic body frequently causes dimensional problems. Moreover, the cement sometimes creeps into the area of the connector pins and interferes with electrical contact or prevents proper mating of the two connectors.

The present invention is described as embodied in an integral metal sheath that overcomes many of the disadvantages of the conventional independent skirts and provides other important advantages.

It is an object of this invention to provide a NAFI type connector having a single-piece sheath that replaces both of the metal skirts to reduce the cost and time of assembly and eliminate special assembly fixtures.

It is a further object of the invention to provide such a connector in which the projecting skirts are maintained in position by the structural strength of the sheath eliminating the possibility of a skirt pulling loose from the plastic body and obviating the need for pull tests during manufacture or acceptance.

It is a further object to provide such a connector having a high degree of dimensional stability and uniformity.

It is another object of this invention to reduce significantly the amount of adhesive used in the construction and substantially eliminate the creeping of the adhesive into the area of the connector pins.

It is still another object of the invention to provide such a connector having increased resistance to accidental damage such as frequently results from dropping or hitting the connector.

It is yet another object to provide such a connector having increased strength in the area around the positioning keying pin and in which the keying pin is held in position by metal rather than solely by plastic.

It is a primary object of this invention to provide such a connector having improved reliability, economically achieved through the use of an H-shaped extruded sheath.

These and other objects of the invention will be apparent from the following description of a preferred embodiment of the invention considered in conjunction with the following drawings, in which.

Figure 1:
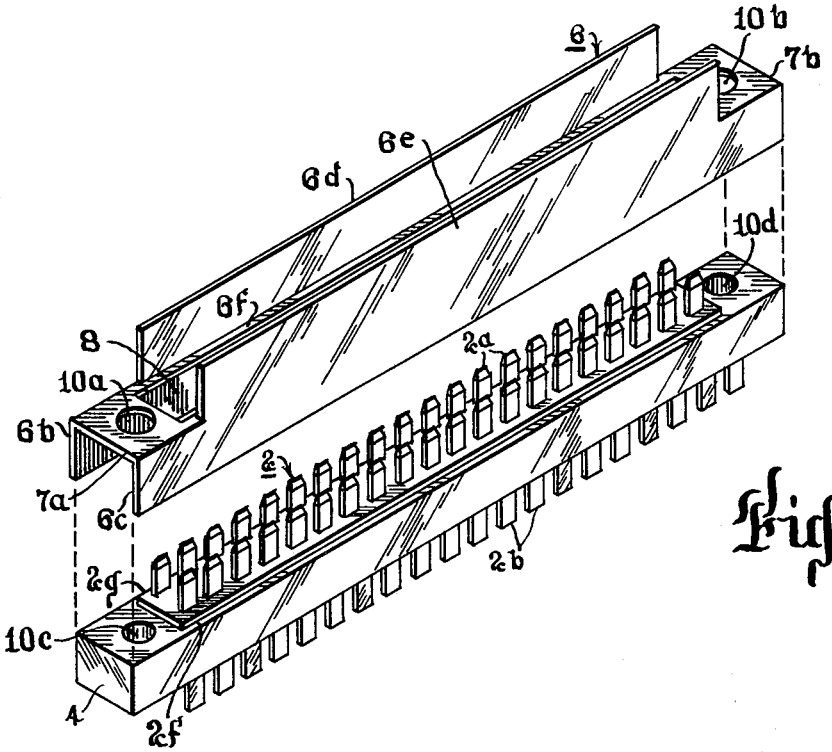
FIG. 1 is an exploded perspective view of a connector embodying the invention.
Figure 2:
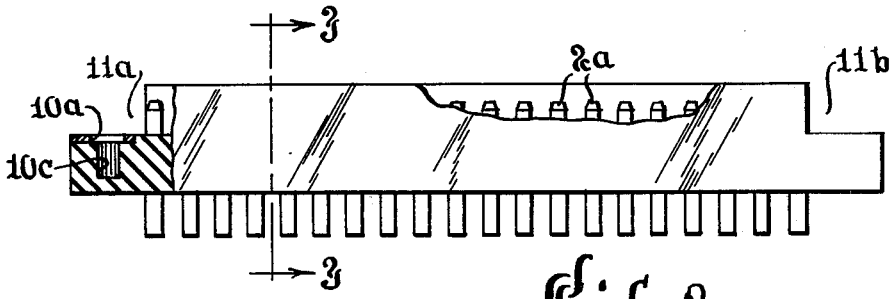
FIG. 2 is an elevational view of the connector of FIG. 1 with certain parts cut away to show the interior construction of the connector.
Figure 3:
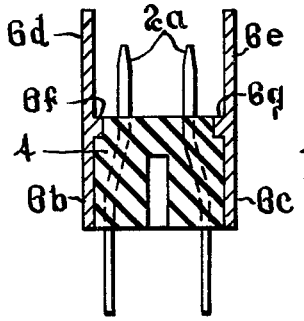
FIG. 3 is a sectional view taken along line 3—3 of FIG. 2.
Figure 4:
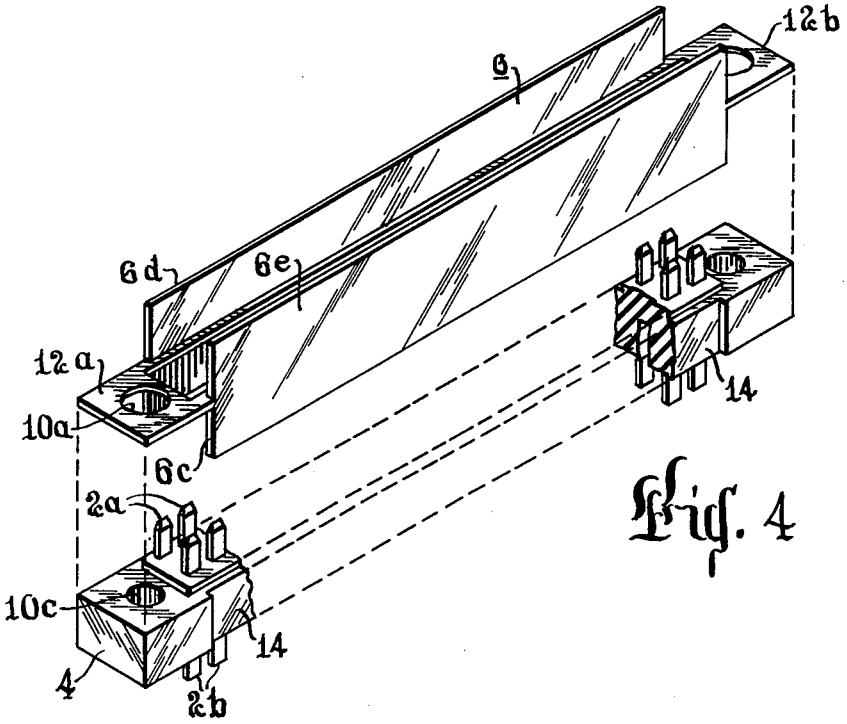
FIG. 4 is an exploded perspective view of a similar connector having a modified sheath.
Figure 5:
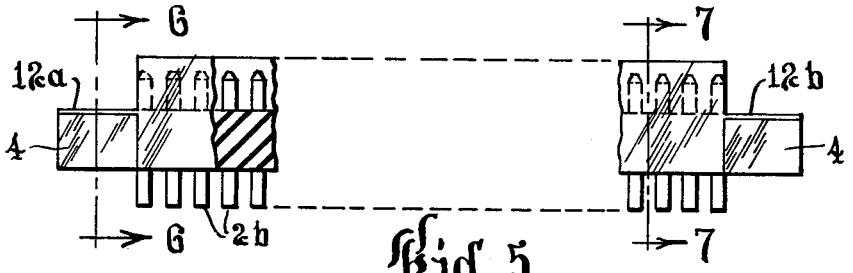
FIG. 5 is an elevational view of the connector of FIG. 4 with portions of the sheath and plastic body cut away.
Figure 6:
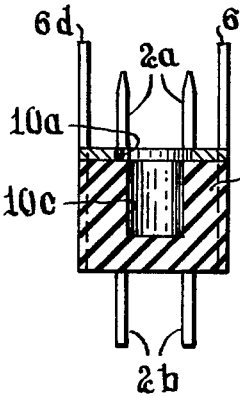
FIG. 6 is a sectional view taken along line 6—6 of FIG. 5.
Figure 7:
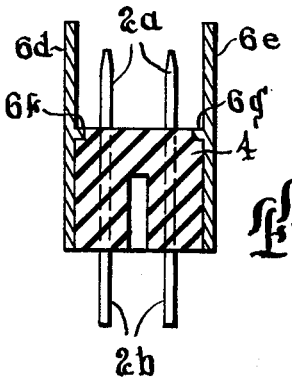
FIG. 7 is a sectional view taken along line 7—7 of FIG. 5.
Figure 8:
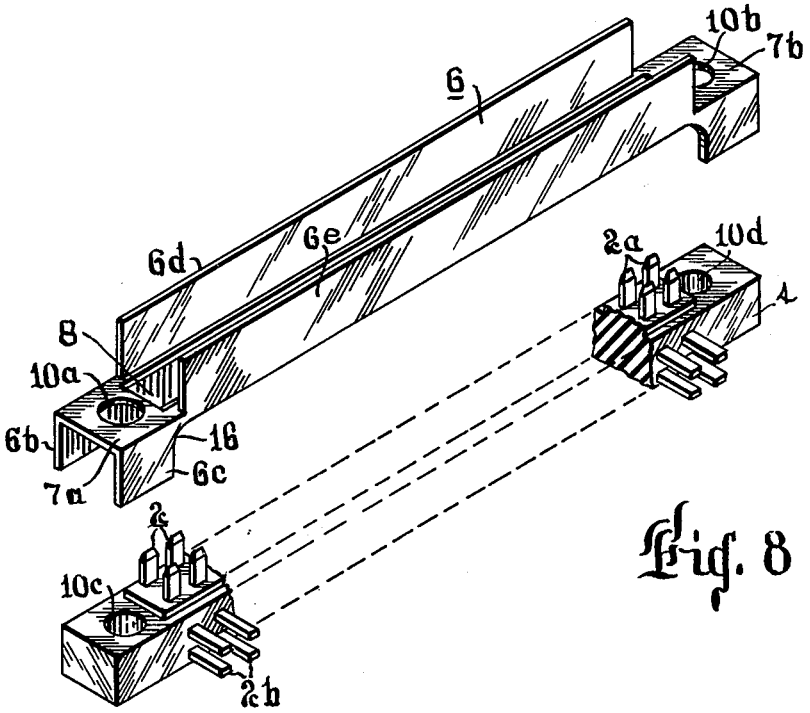
FIG. 8 is an exploded perspective view of a connector similar to that shown in FIG. 1, but in which the permanent connection portions of the pins extend from a side wall of the plastic body.
Figure 9:
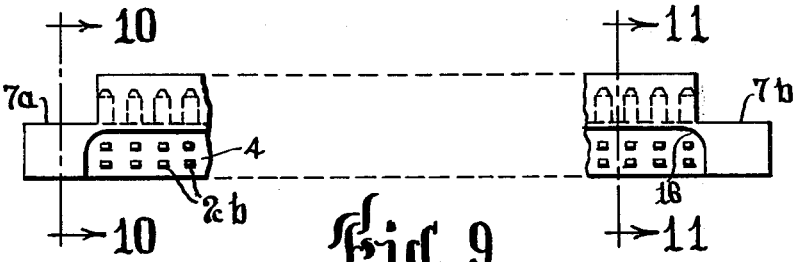
FIG. 9 is an elevational view of the connector shown in FIG. 8.
Figure 10:
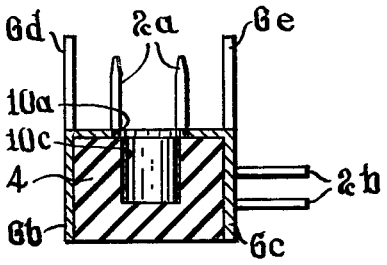
FIG. 10 is a sectional view taken along line 10—10 of FIG. 9.
Figure 11:
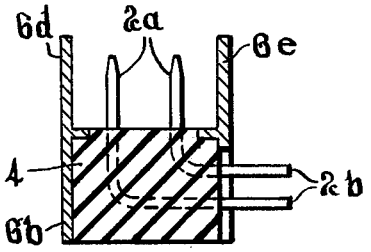
FIG. 11 is a sectional view taken along line 11—11 of FIG. 9.

In the connector shown in FIGS. 1, 2, and 3, two rows of pins, generally indicated at 2, are embedded, by molding, into a plastic body 4, each of the pins having a connection portion **2*a* extending from one surface of the body 4 and adapted for making a removable connection with an individual receptacle of a female connector (not shown). The opposite end portion 2*b* of each pin extends from the opposite surface of the body 4** and is adapted for making permanent connection to any desired electrical circuitry. The connector may be of any length and include any desired number of connection pins.

To provide reinforcement for the body 4 and protection for the exposed connection pins **2*a*, a sheath, generally indicated at 6, is fitted over and cemented to the plastic body 4. The sheath 6 is formed of aluminum, such as 6063-T5 or T6, extruded as an H-shaped section. This H-shaped section includes two connecting bridges 7*a* and 7*b*, two downwardly-extending parallel flanges 6*b* and 6*c*, and two upwardly-extending parallel pin-protection skirts 6*d* and 6*e*. A central part of the cross of the H-shaped extrusion, between the bridges 7*a* and 7*b*, is removed, as by punching, to leave a rectangular opening 8 that allows the connection pins 2*a* to extend into the space between the skirts 6d and 6e. This opening 8 is slightly less in width than the transverse distance between the opposing skirts 6d and 6e to leave two longitudinal inwardly extending ribs, as shown at 6f and 6g in FIG. 3, along each side of the sheath. These ribs typically project about 0.020 inches and are dimensioned to mate nicely with notches 2f and 2g formed along the edges of the body by a raised area on the central part of the surface of the body 4. These ribs provide added strength for the sheath and insure proper positioning of the sheath 6 on the body 4**.

The flanges 6b and 6c are secured to the side surfaces of the body 4 by a small amount of a suitable cement, such as an epoxy or other glue. Because the flanges 6b and 6c are maintained rigidly in position by the mechanical construction of the assembly, only a very small amount of cement is applied and this small amount is less than that which would cause either dimensional problems or the creeping of the cement into the pin area, both of which are recurring problems with the separate skirts heretofore in use.

To align and maintain alignment between the male and female connectors, a pair of keying pins (not shown) are secured, by epoxy cement or other adhesive, in the openings 10c and 10d in the plastic body 4 and extend through the openings 10a and 10b in the bridges 7a and 7b of the sheath to engage matching openings in the female connector (not shown). The H-shaped extrusion need not be of uniform thickness and if desired the bridges 7a and 7b can be made thicker to provide increased support for the keying pins. With this arrangement, the metal sheath provides reinforcement for the plastic and reduces likelihood of accidental damage. After the formation of the sheath is completed, it is anodized to provide corrosion resistance and electrical insulation.

If the keying pins being used for alignment are of uniform diameter, the openings 10a and 10b in the bridges 7a and 7b are the same size as the openings 10c and 10d in the plastic body 4. The keying pins may, however, have a shoulder formed by a larger diameter adjacent the part that enters the plastic body and, in that event, the openings 10a and 10b are sized as shown in FIG. 2 to fit the enlarged portion of the keying pins and provide sturdy support.

To avoid interference with the mating connector (not shown), the portions of the pin-protection skirts 6d and 6e adjacent each end and outside the pin area are removed as generally indicated at 11a and 11b in FIGS. 1 and 2.

FIGS. 4 to 7, in which parts corresponding to those of FIGS. 1 to 3 are identified by corresponding numbers, illustrate an alternative arrangement in which the U-shaped end sections of the sheath 6 are replaced by two planar tabs which serve as bridges 12a and 12b, formed by removing the portions of the flanges 6b and 6c adjacent each end and beyond the pin area. Otherwise the construction of the sheath 6 is unchanged.

In this embodiment, the thickness of the plastic body 4 is reduced, as shown at 14, on each side adjacent the pin area by an amount equal to the thickness of the flanges 6b and 6c. The resulting groove 14 receives the flanges 6b and 6c to form smooth side surfaces the full length of the connector.

FIGS. 8 to 11, in which parts the same as those of the earlier drawings are identified by corresponding numbers, show an alternative construction in which the permanent connection portion 2b of the pins 2 emerges from the side of the plastic body 4. To provide space for the pins on the side, the U-shaped bridge arrangement of FIG. 1 is used at each end of the sheath 6 and a portion of the flange 6c is cut away, as illustrated at 16 in FIGS. 8 and 9, to provide clearance for the permanent connection portions 2b of the pins 2. The remainder of the construction may be the same as shown in FIGS. 1 to 3.

From the foregoing it will be seen that my invention is well adapted to meet the ends and objects herein set forth, is subject to various modifications to best adapt it to the particular needs of specific applications, and is capable of being economically manufactured.

I claim:

1. An electrical connector of the type adapted to mate with a female connector having a pair of receptacles each adapted to receive a keying pin, comprising a plastic body having an opening adjacent one end adapted to removably receive one of said keying pins, a plurality of metal connector pins each embedded in and having a projecting portion extending from one surface of said plastic body, and an integral extruded sheath of H-shaped cross section positioned on said body and having a pair of side walls with parallel planar portions positioned in contact with opposed surfaces of said plastic body and each having an integral skirt portion extending therefrom for a distance at least equal to the length of said projecting portions of said pins, and a bridge formed integrally with said side walls and maintaining said side walls in fixed space relationship, said bridge having a transverse opening positioned in alignment with said opening in said plastic body, thereby to reinforce said plastic adjacent said opening.

2. A connector as claimed in claim 1 wherein each of said side walls includes on its inner surface a longitudinal reinforcing rib, each of said ribs being an integral part of one of said side walls and positioned in contact with said plastic body.

3. A connector as claimed in claim 2 wherein said H-shaped sheath is formed of anodized aluminum.

4. A connector as claimed in claim 1 wherein said bridge is a planar tab extending beyond the area of said side walls.

* * * * *